United States Patent [19]

Brookhyser

[11] Patent Number: 4,658,684

[45] Date of Patent: Apr. 21, 1987

[54] OSCILLATING GUILLOTINE CLIPPER FOR WOOD VENEER

[76] Inventor: Byron Brookhyser, P.O. Box 756, Milton, Wash. 98354

[21] Appl. No.: 765,859

[22] Filed: Aug. 14, 1985

[51] Int. Cl.[4] ..... B27L 5/08

[52] U.S. Cl. ..... 83/289; 83/303; 83/315; 83/321; 83/346

[58] Field of Search ..... 83/303, 317, 315, 371, 83/343, 346, 321

[56] References Cited

U.S. PATENT DOCUMENTS 2,394,324 2/1946 Miller ..... 83/315
4,397,204 8/1983 Columbo ..... 83/371

*Primary Examiner*—Donald R. Schran
*Attorney, Agent, or Firm*—Seed and Berry

[57] ABSTRACT

A clipper for cutting wood or plywood veneer transversely and other similar continuous sheet materials is described which ensures that the sheet material is cut in alignment and the cut achieves a square edge on the material. The clipper includes at least a pair of guillotine knife blades, each blade extending transverse to the sheet material, each blade cutting against a single anvil cylinder rotating in synchronization with the sheet speed. Each blade is preferably mounted in an actuating assembly which includes a crankshaft and a connecting rod. The blade is journaled to the crank of the connecting rod at its lower portion. The upper end of the connecting rod is guided along a radial line with respect to the center line of the anvil. Upon turning the crankshaft, the blade advances simultaneously vertically and horizontally into contact with the veneer. The imparted motion is such that the blade always remains substantially perpendicular to the surface of the veneer being cut. Thus the cut achieves a square edge on the veneer. The apparatus also ensures that forward conveyance of the veneer is not disturbed by the knife or anvil. Thus, the veneer is cut in transverse alignment and it exits the clipper aligned and in register with the conveyors.

5 Claims, 6 Drawing Figures

OSCILLATING GUILLOTINE CLIPPER FOR WOOD VENEER

TECHNICAL FIELD

The invention relates to apparatus for cutting sheet material intermittently into useful lengths. More particularly, the invention relates to cutting a continuously traveling sheet of wood veneer intermittently into lengths suitable for plywood lay-up, for example.

BACKGROUND ART

In the manufacture of plywood, a thin layer of veneer is peeled in a continuous sheet from a log mounted on a lathe. The log blocks from which the veneer is cut are generally of a length equal to that of a desired finished plywood sheet. The continuous sheet of plywood veneer travels on conveyors adjacent a cutting knife or clipper which cuts the veneer transversely to the direction of travel of the sheet into incremental widths suitable for lay-up into a plywood sheet of desired width. Where the quality of the plywood veneer meets the specifications of the plywood component for which it is intended, the plywood clipper need be actuated only as necessary to achieve the desired width of the finished panel. However, most veneer as it is peeled contains defects resulting from knots, rot or splits in the log block. In order to eliminate voids and consequently reduced strength in the finished panel product, defects must be substantially removed.

In conventional practice, a clipper is actuated intermittently, in response to sensors which detect the defects. The clipper cuts out the defect portion by making incremental transverse cuts across the sheet, as often as necessary, to rid the veneer of the defects. The result is a collection of incremental pieces of veneer which must then be laid up edge-to-edge to form a panel component of the desired width. Three or more of the panel components are then typically sandwiched or layered together with an adhesive and pressed to form a finished panel having a requisite strength. In most mills, veneer strips that are at least 8 inches wide are usable in the lay-up process.

In a typical veneer production stream, up to 30% of the veneer will contain defects requiring removal. Conventional clipping apparatus and techniques reduce the loss of good veneer to about 10%. A significant portion of the veneer loss is due to inaccurate transverse cutting of the veneer. Also, present day apparatus lack the ability to cut out the narrower defects, which often are such that only a one-half inch width of veneer need be discarded.

Veneer mills and the plywood industry use two cutter or clipper concepts. The oldest concept employs a guillotine-type clipper blade which extends transversely to the direction of travel of the veneer and is actuated by an upstream sensor means which detects the defect. The guillotine impacts a stationary anvil surface which the veneer slides across as it travels under the blade.

The second conventional concept employs a rotating anvil roll and an upper, opposed roll upon which a knife blade is mounted extending transversely across the sheet. The veneer travels across the anvil roll, and upon a defect sensor actuating rotation of the upper roll, the knife blade rotates into contact with the anvil roll, thereby severing the veneer.

Hards, in U.S. Pat. No. 3,808,925, describes some disadvantages of the guillotine clipper and limitations of the rotating drum clippers. There are advantages to the guillotine-type clipper. For example, the rigid knife blade and frame of the guillotine clipper and its vertical action make optimum, accurate cuts through the veneer that are transversely aligned and perpendicular to the surface of the veneer. The rotating drum clippers, however, with a substantial radius of knife motion and adequate rigidity of knife mounting, only approach the quality of cut of the guillotine clipper.

The quality of the cut of the veneer is critical in subsequent processing or lay-up of the veneer into plywood. If the veneer strips are inaccurately cut, that is, not cut substantially exactly transverse to the continuous sheet of veneer, assembly of the resulting trapezoidal rather than rectangular veneers into a panel will leave gaps either at the ends of the panels or somewhere in the middle when the ends are squared up with respect to the edge of the outer surface sheets. Obtaining a cut that is perpendicular to the surface of the veneer, that is, a square-edged cut, is likewise important in plywood lay-up. A beveled edge has a tendency for overlapping adjacent veneer increments when they are crowded edge-to-edge to make up a finished sheet panel component.

The rigidity of the clipper blade and anvil assembly also affects the performance of the clipper over time. The more elastic the machine parts, the deeper the knife must be set to cut into the anvil in order to ensure complete transverse severence of the veneer. The transverse length of the cut, wood species, presence of knots, or cross grain, density and thickness affect cutting quality of the less rigid apparatus. Where a cut is unexpectedly easy, the knife cuts deeper into the anvil. The degree of such overcutting is in inverse proportion to the rigidity of the mechanism. Overcutting erodes the anvil material and must be compensated for by adjustments of the knife, and eventual replacement of the anvil. The less rigid apparatus typically have greater production downtime and maintenance costs.

As pointed out by Hards, alignment of the cuts transversely with respect to veneer flow is also dependent upon how well the drives on each end of the knife are synchronized and by the rigidity of the knife with respect to torsional deflection.

A remaining principal deficiency of all conventional clippers is the limitation of narrowness of the clips. Narrow defects must be removed from veneer with minimal waste of good veneer and reasonably narrow strips of acceptable veneer must be salvaged. The object of the Hards invention was to improve the narrowness of defect removal capability by reducing the radius of rotation of the knife to the least possible dimension.

Plywood mills often overspeed rotation of rotary clipper rolls to make narrower clips. The width of the defect that can be clipped by overspeeding the rotary knife is limited to about between only 2.5–4 inches at veneer flow rates commonly employed. Also, overspeeding of the rotary knife often causes disarrangement or misalignment of the veneer, especially as the narrower strips exit the clipper.

Recently, manufacturers of larger diameter and more rigid rotary clippers have included up to three knives on the knife holder drums in attempting to achieve narrower clipping capabilities. One manufacturer of veneer handling machinery, as shown by Colombo in U.S. Pat. No. 4,397,204, has combined two rotary clippers, each with three blades, and separate anvil rolls. While this system theoretically permits narrow defect clipping of about one inch or less in width, success is limited because the veneer loses register from one clip to the next. The veneer strips must transfer from a first anvil roll after the first clip to a section of conveyor and then to the second anvil for the adjacent, second clip. Precision of register or alignment for the second clip is difficult to maintain, and is a serious productivity limitation of the design. This machinery also suffers from complexity and high maintenance requirements.

DISCLOSURE OF THE INVENTION

It is an object of the invention to provide a clipper apparatus that is capable of cutting defects of any width from a continuously traveling sheet material, in contrast to the prior art, which is limited in the width of defects that may be productively eliminated.

The oscillating clipper apparatus of the present invention is a high-speed, accurate apparatus for cutting traveling sheet material, such as wood veneer, transverse to its direction of travel. The apparatus provides the capability of removing defects as small as one-half inch, as opposed to the 2.5–4 inch limit of the prior art.

It is likewise an object of the invention to provide a clipper which produces straight transversely aligned cuts. This result is achieved by rigidly supporting the blade across the sheet material. The invention employs two guillotine-type knives vertically actuated independently, which allows defect width removal of any width. Accurate cutting results from spacing the knives close together so that they cut against the same rotating anvil roll so that precision of adjacent clips is not adversely affected by intervening conveying devices.

It is likewise an object of the invention to provide for and ensure that each cut produces a square edge on the sheet material. This object is accomplished by guiding the vertical motion of the clipper blade such that the cutting action is substantially perpendicular to the sheet material.

The apparatus of the present invention is designed for intermittently cutting traveling sheet material transverse to its direction of travel. The apparatus includes a cylindrical anvil across which the sheet is conveyed and travels. The anvil momentarily supports and positions the sheet, with the cylinder supporting surfaces rotating in substantial synchronization with the sheet speed. The apparatus includes a plurality of knives, preferably two, each extending transverse to the sheet travel. The knives are capable of cutting the sheet into transverse increments as narrow as desired. The knife blades are each suspended by an actuating system that supports the knife blade adjacent and opposed to the anvil roll. The actuating means advances the knife simultaneously vertically and horizontally into momentary contact with the rotating anvil, which causes the sheet material to be cut through transversely. The motion and alignment are such that the veneer or sheet material leaves the clipper in alignment with respect to the traveling sheet and each cut produces a rectangular edge on the sheet. The cutting is done without interrupting the continuous travel of the sheet material. The apparatus further includes a sensor that initiates and sequences the actuating system in response to a measured characteristic, usually a defect, of the sheet material. A preferred method of operation requires the sensing means to actuate the first knife to cut one edge of the defect and a second knife to cut the other edge of the defect. The apparatus is most useful where the sheet material has a substantial thickness and must eventually be abutted edge-to-edge, requiring a substantially square cut edge.

The actuating means preferably includes a crankshaft supported at a plurality of journal bearing points transverse to sheet travel to impart transverse rigidity and alignment to the blade. The crankshafts include a number of eccentrics or cams spaced transverse to the sheet to which the knife means is journaled. Revolution of the crankshaft causes the knife to circumscribe an elliptical path into momentary contact with the anvil, thereby cutting the sheet therebetween.

Where the crankshaft means is employed, the apparatus includes a plurality of connector rods for supporting and guiding the blade. The connector means includes a lower portion to which the blade is attached and which is journaled to the crankshaft element. The upper portion of the connector rod is confined by a guide to substantially vertical movement. This guiding means fixed to a frame member orients the movement of the blade to ensure that it always advances into cutting contact with the sheet at a knife angle that is always substantially perpendicular to the sheet surface.

BEST MODE FOR CARRYING OUT THE INVENTION

Figure 1:
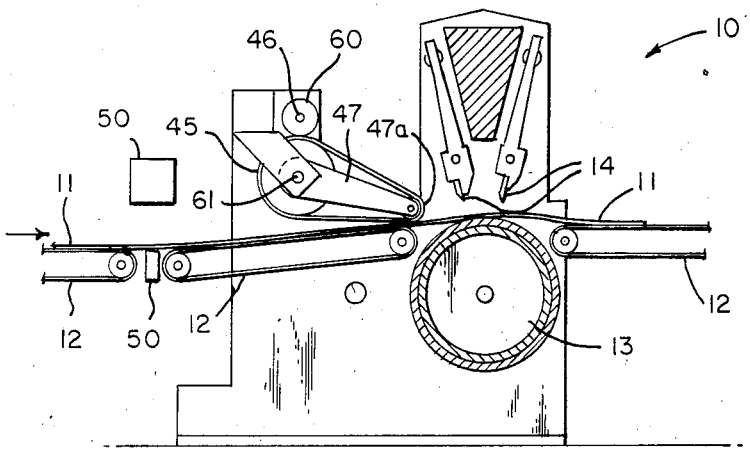
FIG. 1 is a schematic end view of the oscillating clipper of the invention.

Referring to FIG. 1, a schematic sectional end view of the clipper of the invention 10 shows plywood veneer 11 traveling in a substantially continuous sheet supported by a series of conveyors 12 onto a supporting anvil 13. The anvil 13 rotates with a cylindrical surface speed synchronized to that of the speed of the conveyors 12.

A pair of guillotine cutting knives 14, each extending across the entire width of the veneer sheet, oppose the rotating anvil 13.

Figure 2:
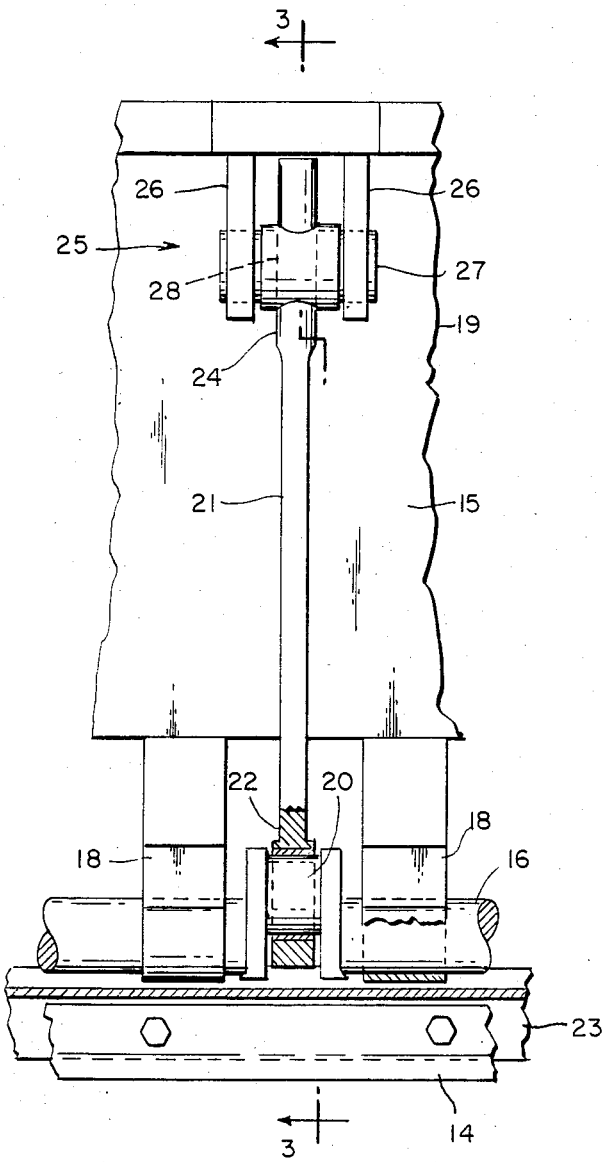
FIG. 2 is a view, in the direction of travel of the sheet material, of the knife blade-actuating system.
Figure 3:
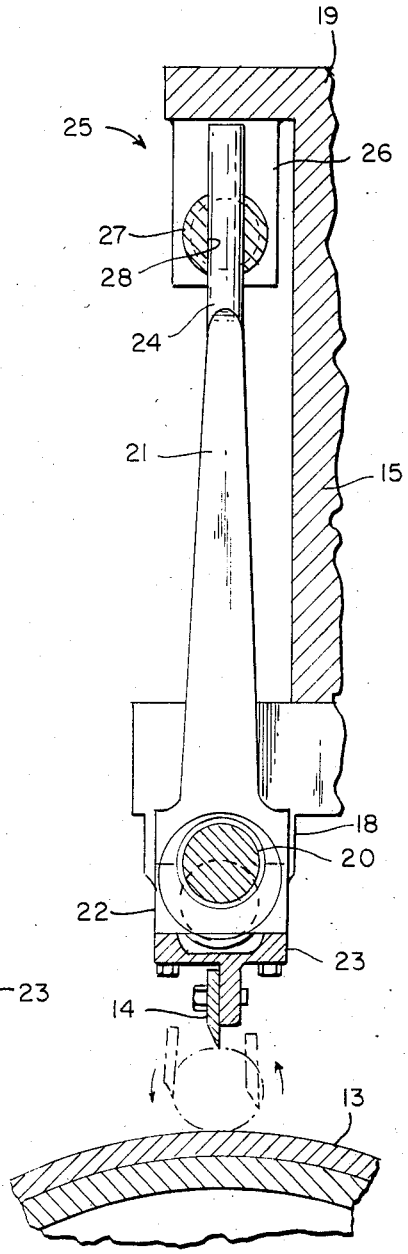
FIG. 3 is a partial section along lines 3—3 of FIG. 2 of the knife blade-actuating means.

An actuating assembly 15, best shown in FIGS. 2 and 3, supports and guides each of the knives 14 into cutting contact with the veneer 11 as it travels across the anvil cylinder 13. Each knife actuating assembly 15 is driven by a crankshaft 16, 17 that extends transversely across the width of the veneer cutting machine, positioned above the anvil 13. As shown in FIG. 2, the crankshaft is supported at intervals across the machine by bearings 18 fixed to frame 19 so that the shaft is rigidly supported and has a minimum of deflection in the machine direction. The crankshaft 16 is provided with a number of cranks 20 offset from the center line of the shaft, spaced transversely across the width of the machine. The cranks are preferably supported by bearings 18 on each side of the crank.

The actuating assembly 15 further includes connector rods 21 having a lower portion 22 journaled to each crank 20. The knife blade 14 is fixed to knife support 23 which is attached to the lower rod portion 22. Each upper portion 24 of the connector rods 21 is restrained by guides 25 fixed to the frame 19. The guide includes supports 26 in which is journaled a cylindrical rod guide 27 provided with an aperture 28 to receive the connector rod end 24.

The guides are positioned so that the blade and actuating assembly are in radial alignment with the center of the anvil cylinder 13 as best shown in FIG. 1. Turning a crankshaft 16, 17 advances the blade, as shown by the shadow lines in FIG. 3, into contact with the anvil surface 13. The crank offset imparts a horizontal component to the motion such that the blade transcribes a somewhat elliptical pathway, as shown. The combination of the guide alignment of the upper connector rod and the elliptical path of travel of the blade results in the blade always remaining substantially perpendicular to the surface of the veneer during cutting. Thus, a square-edged cut on the veneer is always achieved. The apparatus also ensures that forward conveyance of the veneer is not disturbed by the knife or anvil. Thus, the veneer is cut in transverse alignment and it exits the clipper aligned and in register with the conveyors.

Figure 4:
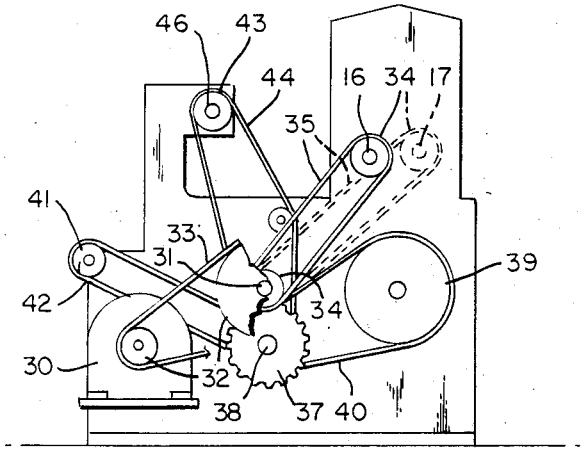
FIG. 4 is an end view showing the drive means for the clipper and associated elements.
Figure 5:
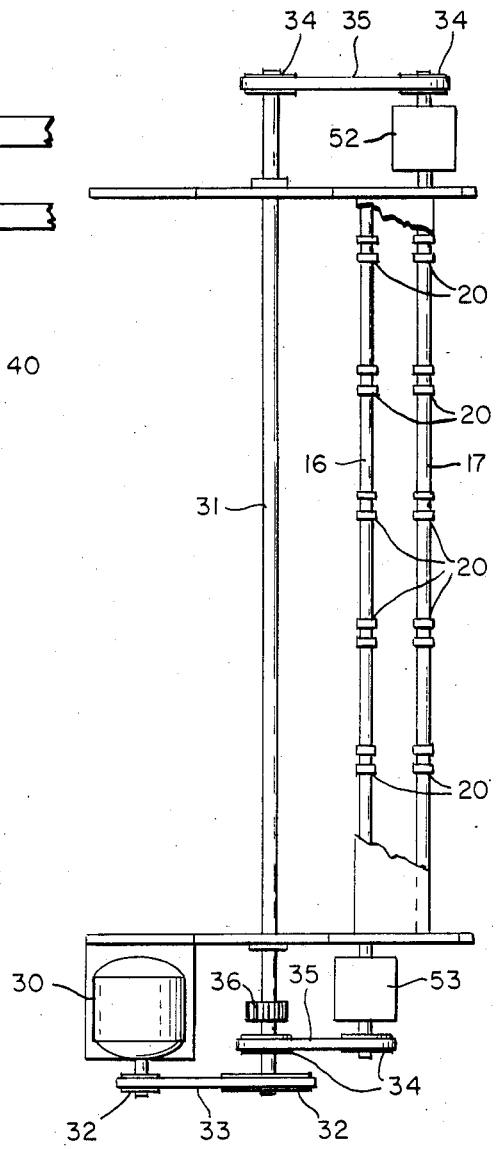
FIG. 5 is a plan view showing only the knife actuating crank shafts, the associated drive elements and supporting frame elements.

FIG. 4 is an end view of the machine showing the driving means for the various machine clipper elements. Various driving elements are shown in plan view in FIGS. 5–6 also. A motor 30 drives a shaft 31 through pulleys 32 and drive belt 33. This main shaft 31 is connected by pulleys and driving belts 34, 35 to each of the crankshafts 16, 17. The shaft 31 includes a pinion gear 36 driving a bull gear 37 mounted on a shaft 38. Pulleys 39 and drive belts 40 drive the anvil cylinder 13. Pulleys 41 and drive belt 42 drive the feed conveyor 12. Thus the anvil cylinder, conveyors, and crankshafts all rotate in synchronization.

Figure 6:
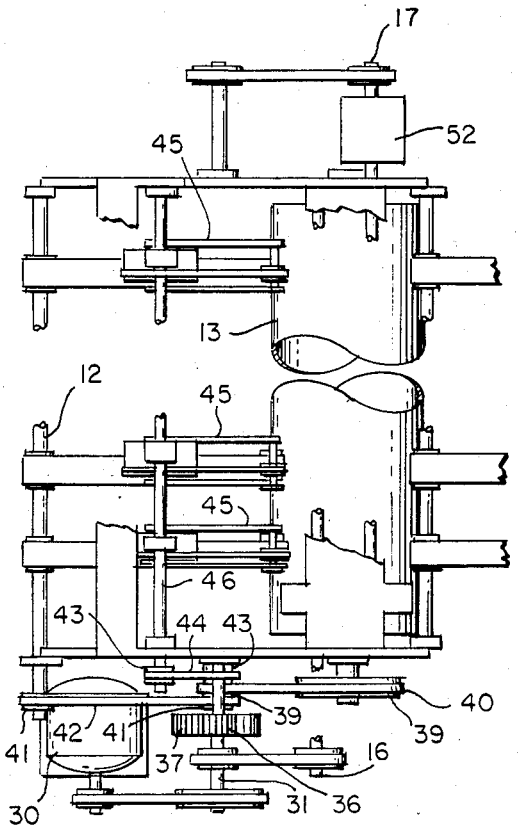
FIG. 6 is a plan view of the clipper assembly of the invention.

The shaft 38 also drives, through pulleys 43, drive belt 44, a traction wheel 60 mounted upon shaft 46, and a veneer hold-down belt 45 mounted on shaft 61, best shown in FIGS. 1 and 6. The belt surfaces 45 are extended into contact with the veneer by supporting brackets 47 and pulley **47*a* just as the veneer transfers to the anvil cylinder 13. The hold-down belt 45** turns in synchonization with the other rotating elements, helping maintain proper alignment of the veneer during clipping.

In operation, a sensor 50 detects the leading and trailing edges of a defect in veneer 11, relaying the signal to a remote time delay programmer (not shown). At the proper time, the programming unit actuates a clutch unit 52 or 53 on one of the blade-actuating assembly crankshafts 16, 17.

Preferably, the first knife 16, with respect to the traveling veneer, cuts at the leading edge of the defect. The second knife 17 then cuts the trailing edge of the defect. This sequence further helps ensure proper alignment of the veneer during cutting. When clipping continuous ribbons of good veneer into desired widths, the knives may be controlled to clip alternatively.

It will be obvious to those skilled in the art that the clipper apparatus of this invention is useful for clipping materials other than wood veneer. In fact, any traveling sheet material having a substantial thickness where it is important that the cut edges have true alignment and a square rather than beveled profile can be cut utilizing this system.

With respect to the mechanical aspects of the invention, substitutes within the scope of the invention will likewise be obvious to those skilled in the art. For example, the actuating assembly crankshafts may be replaced by any rotating element having cams or eccentrics which impart the elliptical-like motion to the blade edge which achieves the square edge cut. The drive systems likewise could be made up of meshing gear systems rather than pulleys and drive belts. Likewise, cog or toothed belts and roller chain may be used as driving elements.

What is claimed is:

1. An apparatus for intermittently cutting traveling sheet material transversely to its direction of travel, comprising:

a cylindrical anvil, rotating at synchronous speed with said traveling sheet, for momentarily supporting and conveying said sheet;

a pair of knives, each extending across said sheet and adjacent to said anvil, for cutting said sheet into transverse segments as said sheet is supported by said anvil;

an actuating assembly means for supporting each knife adjacent and opposed to said anvil and simultaneously, individually advancing each knife horizontally, in synchronization with said traveling sheet, and vertically into momentary contact with said anvil, whereby said sheet is cut transversely without disrupting segment alignment with respect to the sheet or interrupting conveying of said cut segments; and sensing means for sensing characteristics of said sheet and in response initiating said actuating means individually for each knife, whereby segments of desired narrowness are cut in said traveling sheet.

2. The apparatus of claim 1 wherein said actuating means comprises a crankshaft means supported at a plurality of journaled bearing points transverse to said sheet to impart rigidity to said blade, said crankshaft further including a plurality of crank eccentrics spaced transverse to said sheet to which said knife means is journaled, whereby revolution of said shaft causes said knife to circumscribe an elliptical path into momentary contact with said anvil.

3. The apparatus of claim 1 wherein said actuating means includes a plurality of connecting rod means for supporting and guiding said knife means at each crank eccentric, each rod including a lower portion to which said knife is fixed and journaled to said crank eccentric and an upper rod portion confined and guided to circumscribe a substantially vertical movement; and a guiding means fixed to a supporting frame transverse to said sheet for guiding the vertical movement of each connecting rod upper portion such that the knife means advances into cutting contact with said sheet with a knife angle that is always substantially perpendicular to said sheet surface as it passes over said anvil roll.

4. An apparatus for cutting a continuously traveling sheet of material, having a substantial thickness, transversely without interrupting the continuous flow of said material, said apparatus comprising:

an anvil across which said material is conveyed;

a plurality of knife blades, each of which extends transversely across said sheet material;

a knife actuator assembly for each knife blade for advancing said blade vertically, and simultaneously, horizontally, into cutting contact with said sheet material, whereby said cutting is synchronized with the conveyance of said sheet material across said anvil, each assembly further including:

a plurality of connector rods spaced transverse to said sheet material to which lower portion each knife blade is fixed, guides receiving an upper portion of each connector rod for restraining and guiding the vertical motion of said rod, whereby said blade cuts said material perpendicular to its major surface, resulting in a square cut edge on said cut material, a shaft transverse to said material for each blade, including a plurality of cam eccentrics upon which a lower portion of said connector rods is journaled, said shaft provided with a plurality of bearing supports for rigidly supporting said blade into transverse cutting alignment with said sheet material, and sensors for initiating said knife or assembly in response to a measured characteristic of said material.

5. An apparatus for intermittently cutting traveling wood veneer having a substantial thickness, transverse to its direction of travel, comprising:

an anvil, transversely positioned with respect to said veneer sheet, said anvil including surfaces, rotating at substantially the same speed that said veneer sheet is traveling that momentarily support and convey said veneer sheet;

a pair of knife blades transversely positioned, spaced from said sheet and adjacent said anvil;

an actuating assembly that independently supports each blade adjacent and opposed to said anvil and independently simultaneously advances each blade substantially horizontally in synchronization with the conveyed veneer and guides each blade essentially vertically with respect to said veneer such that said blade contacts said veneer and anvil perpendicular to its major surfaces, transversely cutting said veneer without disrupting alignment of said segments with respect to one another or said veneer sheet and producing a square cut edge on said cut sheet, said blades spaced from one another adjacent said anvil to permit simultaneous actuating; and a sensor for sensing defects in said veneer sheet prior to said anvil and, in response, initiating said actuating assembly whereby said knives cut sequentially, producing segments of desired narrowness including said defect.

* * * * *